US006155446A

United States Patent [19]

Alexander et al.

[11] Patent Number: 6,155,446

[45] Date of Patent: Dec. 5, 2000

[54] METHOD FOR ENCAPSULATING WASTE MATERIAL AND SYSTEMS THEREFOR

[75] Inventors: Loren D. Alexander, Wheaton, Ill.; Lloyd L. Piper, II, Houston, Tex.; Thaddeus S. Dzierzbicki, Cary; Cem M. Gokcen, Galesburg, both of Ill.

[73] Assignee: National Seal Corporation

[21] Appl. No.: 08/214,971

[22] Filed: Mar. 17, 1994

[51] Int. Cl.[7] ..... B65D 5/00

[52] U.S. Cl. ..... 220/23.91; 220/495.01; 220/908

[58] Field of Search ..... 220/408, 402, 220/403, 410, 908, 359, 23.91, 495.01

[56] References Cited

U.S. PATENT DOCUMENTS

| | | | |
|---|---|---|---|
| 2,744,655 | 5/1956 | Vnuk | 220/403 |
| 4,124,136 | 11/1978 | Bjelland et al. . | |
| 4,385,953 | 5/1983 | Beck . | |
| 4,665,309 | 5/1987 | Derbyshire | 220/359 X |
| 4,722,474 | 2/1988 | Dropsy . | |
| 4,823,708 | 4/1989 | Wymer et al. | 220/359 X |
| 4,872,589 | 10/1989 | Englehart et al. . | |
| 4,886,164 | 12/1989 | Stein et al. | 220/403 X |
| 5,069,352 | 12/1991 | Harbolt et al. . | |
| 5,110,005 | 5/1992 | Schilling | 220/404 |
| 5,163,555 | 11/1992 | West et al. . | |
| 5,186,351 | 2/1993 | Gallo et al. | 220/402 X |
| 5,196,132 | 3/1993 | Mains et al. | 220/359 X |
| 5,238,137 | 8/1993 | Cornwall | 220/408 X |

FOREIGN PATENT DOCUMENTS 1595227 8/1981 United Kingdom .

OTHER PUBLICATIONS

Lubowitz et al. "Securing Containerized Hazardous Wastes by Encapsulation with Spray–On/Brush–On Resins," EPA Publication No. EPA–600/S2–81–140, Aug. 1981, pp. 1–4.

"Evaluation of Encapsulants for Sprayed–On Asbestos–Containing Materials in Buildings," Report prepared by Batelle Columbus Labs., Oct. 1987, pp. 1–10.

U.S. Federal Register, vol. 57, No. 160, Aug. 18, 1992, pp. 37194–37282.

Lubowitz et al., "Securing Containerized Hazardous Wastes with Welded Polyethylene Encapsulates," EPA Pub. No. EPA–600/S2–81–139, Aug. 1981, Pages.

Unger et al., "Fabrication of Polyethylene Encapsulates to Secure Drums Containing Hazardous Waste," Dec. 19, 1980, pp. 1–24.

*Primary Examiner*—Steven Pollard

*Attorney, Agent, or Firm*—McDonnell Boehnen Hulbert & Berghoff

[57] ABSTRACT

A method for encapsulating waste material and a waste encapsulation system are disclosed. The system includes a transportable, rigid container with a rigid liner that is then sealed to encapsulate the waste material within the sealed liner.

16 Claims, 3 Drawing Sheets

METHOD FOR ENCAPSULATING WASTE MATERIAL AND SYSTEMS THEREFOR

BACKGROUND OF THE INVENTION

1. Field of the Invention

The present invention concerns methods of safely disposing of waste material and systems therefor.

2. Description of the Art

Waste materials and debris are often placed in rolloff boxes, dumpsters, waste carts, railcars, dump trucks and other conventional transportable containers. Waste materials placed in such containers may then be transported to an appropriate site for disposal thereof, typically a landfill, such as a sanitary, industrial or hazardous waste landfill. While these known, transportable containers may be suitable for some types of waste materials, they are unsuitable for many others. For example, hazardous debris may not be safely disposed of by means of these known containers.

More specifically, hazardous debris, which is defined in the Federal Register, Volume 57, No. 180, Aug. 18, 1992, pages 37222–37281 et seq. must be treated by one of a limited list of accepted technologies. Among these technologies are so-called immobilization technologies, which include macroencapsulation, microencapsulation and sealing. Macroencapsulation is described as "application of surface coating materials such as polymeric organics (e.g., resins and plastics) or use of a jacket of inert inorganic materials to substantially reduce surface exposure to potential leaching media. Encapsulating material must completely encapsulate debris and be resistant to degradation by the debris and its contaminants and materials into which it may come into contact after placement (leachate, other waste, microbes)." Id. at 37280.

The use of conventional rolloff boxes, for example, with hazardous debris would not be acceptable because the rolloff boxes do not macroencapsulate or seal the hazardous debris. Yet, the use of conventional transportable waste containers, such as rolloff boxes, is highly desirable from the standpoint of transporting waste material, such as debris, to the eventual disposal site.

The art includes a number of waste container liners, such as U.S. Pat. Nos. 4,385,953; 5,163,555; and 5,110,005. The art also includes references to various transportable containers for cargo and other materials, such as U.S. Pat. Nos. 5,069,352; 4,872,589; 4,722,474; and 4,124,136; and U.K. Patent Specification No. 1,595,227. It is also known to use pieces of high density polyethylene pipe, capped at both ends, to contain hazardous waste materials. Furthermore, it is known to secure hazardous waste materials in metal drums with welded polyethylene encapsulates. However, none of these known techniques and containers adequately addresses the problems presented in safely transporting and disposing of certain waste materials, especially hazardous debris.

Therefore, there is a need in the art for a waste treatment method and a waste treatment system that incorporates the ease of transportation of conventional waste containers combined with secure, safe disposal at a disposal site.

SUMMARY OF THE INVENTION

It is an object of the present invention to provide a means for safely encapsulating waste material for appropriate disposal thereof at disposal sites, preferably landfills, most preferably RCRA Subtitle C permitted landfills.

It is an additional object of the present invention to provide a method for encapsulating waste material such that it is substantially isolated from the eventual disposal environment.

It is yet another object of the present invention to provide a method for encapsulating waste material that provides an easy method of transporting the waste material to the appropriate disposal site.

It is a specific object of the present invention to provide a method for encapsulating waste material for the safe disposal thereof in a multistep process. In the first step, a transportable, rigid container, such as a rolloff box or other suitable container, is provided with a liner disposed within the container. The liner is of sufficient rigidity such that the liner is self-supporting when filled with the waste material and/or fill material in the absence of the transportable, rigid container. In a preferred embodiment, the liner is sufficiently rigid such that it can be freestanding with waste material in its interior in the absence of the transportable, rigid container. The liner additionally defines an interior space and an opening, which is adapted to receive the waste material into the interior of the liner.

In the second step of the inventive method, waste material, such as hazardous debris in a preferred embodiment, is placed in the interior of the liner via the opening. As the third step, the waste material is then sealed into or encapsulated within the interior of the liner by the formation of a seal covering the opening, the seal being substantially impermeable to liquid. In this way, the waste material is effectively encapsulated arid/or isolated within the sealed liner from the external environment.

This isolation or encapsulation is further achieved by the liner being substantially impermeable to liquids and substantially resistant to chemical degradation. In a preferred embodiment, the resistance to degradation is such that the waste material contained in the liner and the materials with which the liner may come into contact after placement at the disposal site, such as leachate, other waste and microbes, do not adversely affect the substantial impermeability or the substantial structural integrity of the sealed liner. In this way, the waste material encapsulated within the sealed liner may be safely disposed of.

In a preferred embodiment of the present invention, the inventive method additionally includes the step of transporting the container, the liner, and the waste material inside of the liner to the disposal site. In this case, the transporting step may occur before, after or simultaneous with the sealing or encapsulating step. In a most preferred embodiment, the liner would be sealed at the disposal site after transportation of the container to the site has occurred.

In another preferred embodiment, the inventive method may include the additional step of disposing of the sealed liner encapsulating the waste material at the disposal site. In this case, the sealed liner encapsulating the waste material would be separated from the transportable, rigid container and appropriately placed at, for example, the landfill. The rigid, transportable container could then be reused, either for conventional hauling or for reuse in the inventive method.

In another preferred embodiment, the inventive method includes the additional step of filling substantially all of the void spaces in the interior of the liner with fill material before, after or during the placement of the waste material in the liner. When substantially all of the voids are filled, the liner can then be sealed. The fill material further stabilizes the structural integrity of the filled liner for safe disposal.

In another preferred embodiment of the present invention, the shape of the liner substantially conforms to the internal shape of the transportable, rigid container. For example, if the transportable container to be used is a rolloff box, the liner would ideally substantially conform to the internal shape of the rolloff box. This provides maximum usage of the internal space of the transportable container, while at the same time minimizing the amount of shifting of the liner within the container that might occur during transport and disposal of the sealed container. However, it is practical to use liners that do not substantially conform to the internal shape of the transportable, rigid container. As but one example of this, a plurality of liners could be placed within a single transportable, rigid container.

In yet another preferred embodiment of the invention, the sealing step is achieved by means of a sealing member. Advantageously, the sealing member substantially conforms to the shape of the opening. The sealing member is then placed in a position relative to the opening such that it substantially covers the opening and a substantially liquid impermeable seal is then formed between the sealing member and the opening. In this way, the waste material within the liner is sealed or encapsulated in the liner from the external environment.

In another aspect of the present invention, a waste encapsulation system is provided for the safe disposal of waste material. This waste encapsulation system includes a transportable, rigid container and a liner disposed within the container. The liner defines an interior space and an opening adapted to receive waste material. The liner is sufficiently rigid such that it is self-supporting when filled with waste and/or fill material in the absence of the transportable, rigid container. The liner is also substantially impermeable to liquids and substantially resistant to chemical degradation. The liner is additionally adapted to form a substantially liquid impermeable seal over the opening. In use, the inventive waste encapsulation system may receive waste material and/or fill material in the interior of the lining via the opening and the waste and/or fill material may then be encapsulated within the sealed liner. The liner and the waste material may be transported in the transportable, rigid container to a disposal site and the sealed liner may be disposed of therein.

Further objects and embodiments of the present invention will be described below.

DESCRIPTION OF THE PREFERRED EMBODIIENTS

Figure 1:
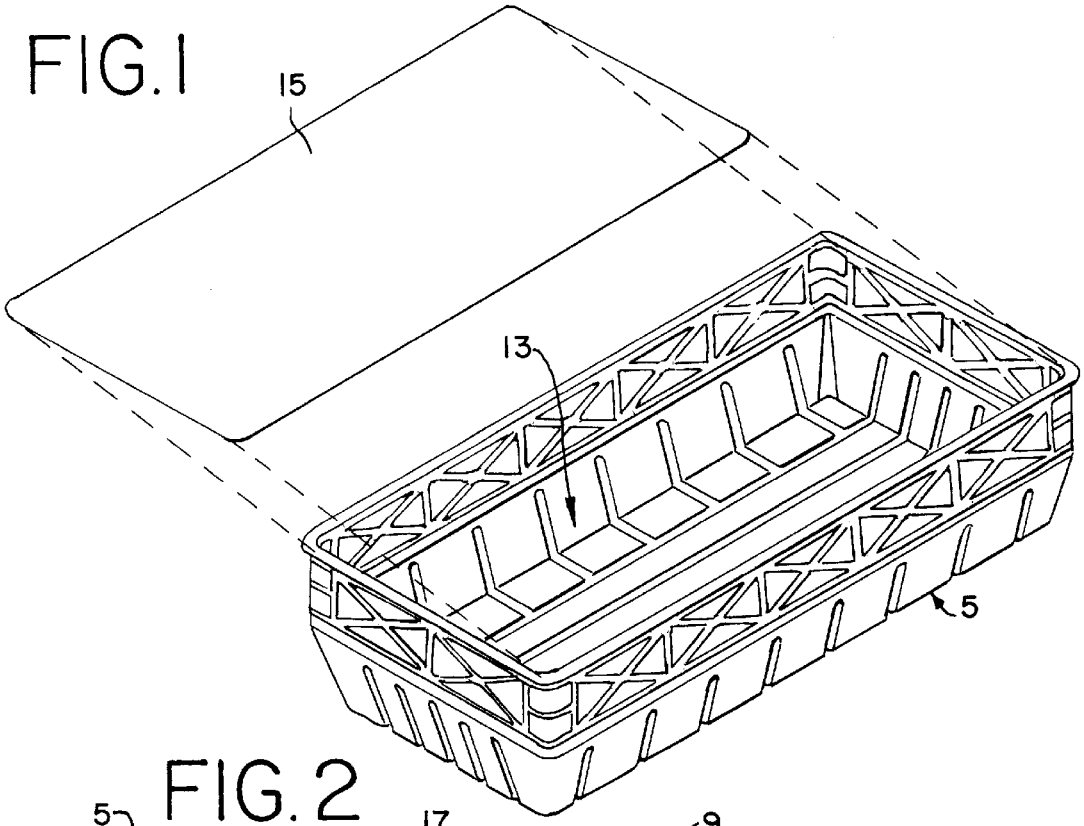
FIG. 1 is an isometric view of a liner and a sealing member of a preferred embodiment of the present invention, the dotted lines showing the spatial relationship of the two parts.
Figure 2:
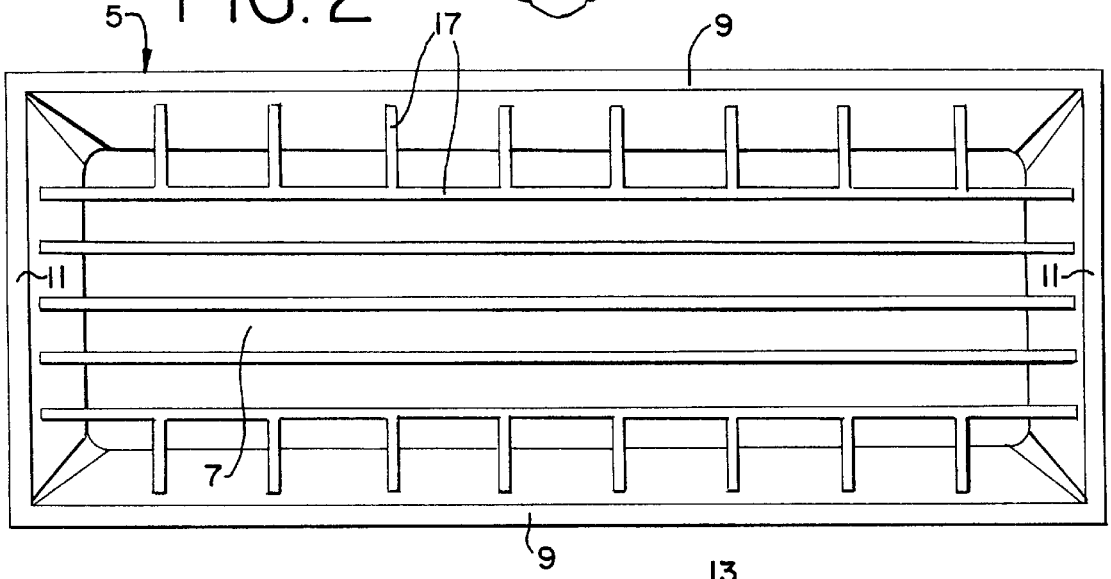
FIG. 2 is a top view of the liner of FIG. 1.
Figure 3:
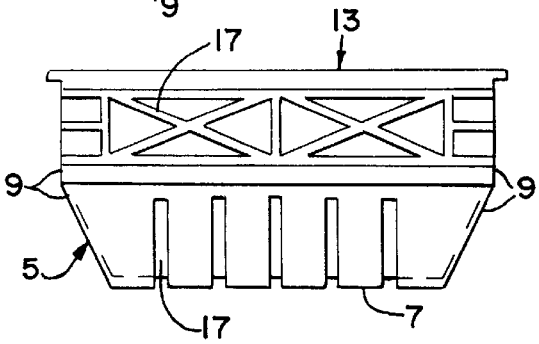
FIG. 3 is an end view of the liner of FIG. 1.
Figure 4:
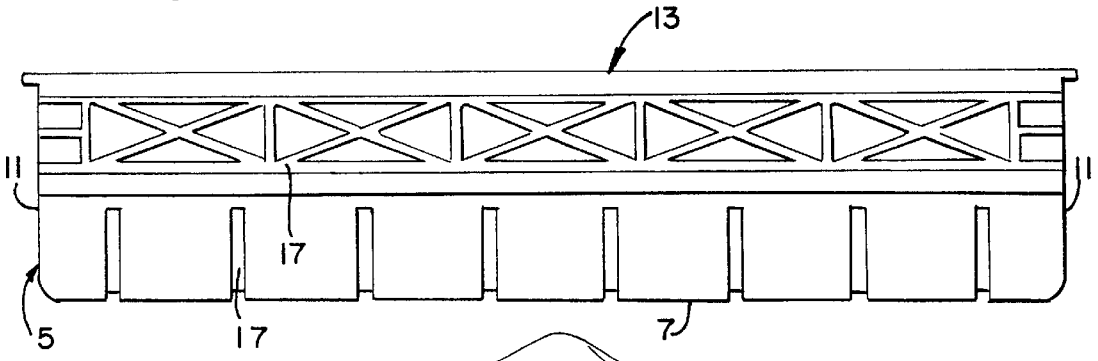
FIG. 4 is a side view of the liner of FIG. 1.
Figure 5:
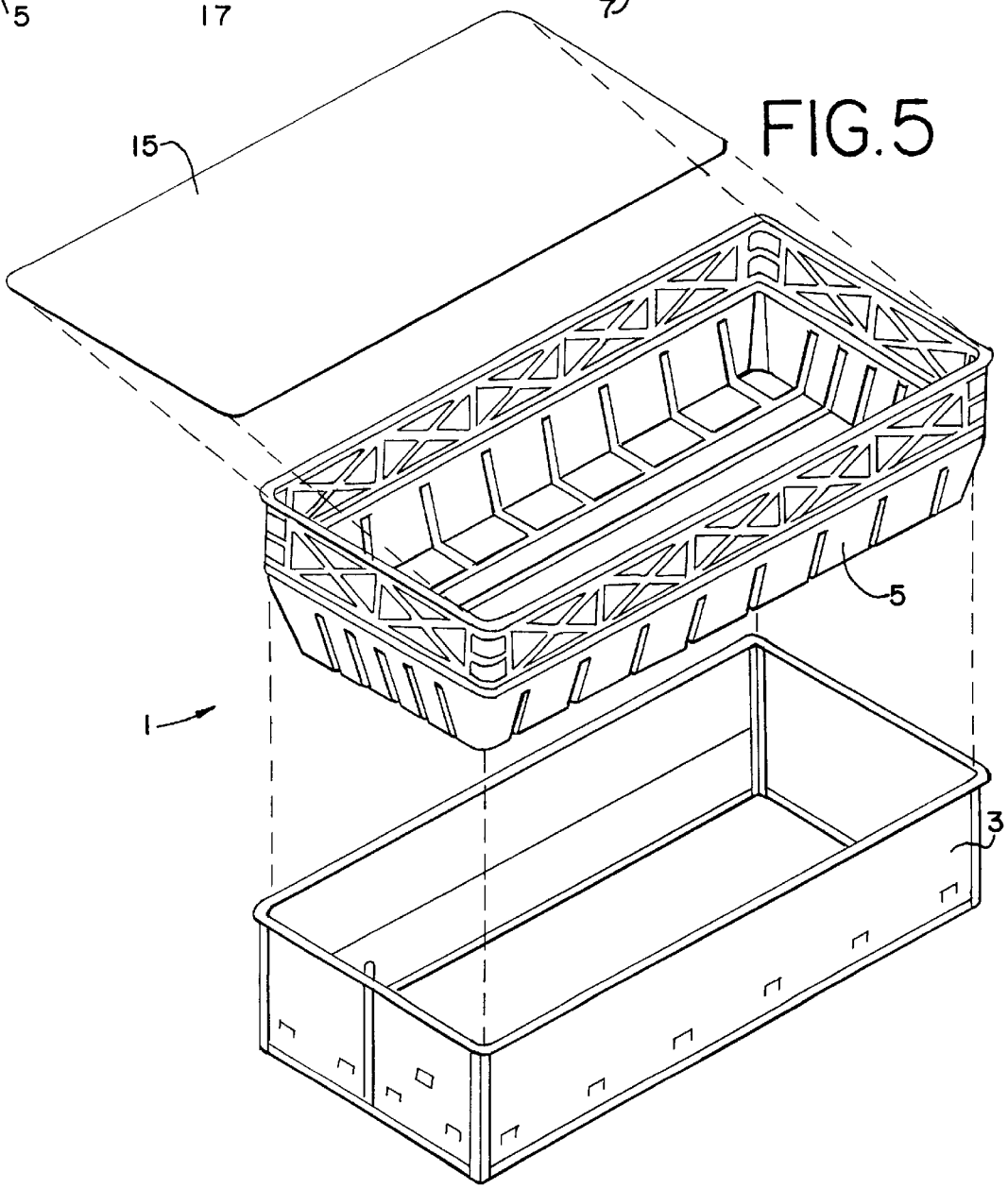
FIG. 5 is a perspective view of a liner, a transportable, rigid container and a sealing member according to a preferred embodiment of the present invention, the dotted lines shown the spatial relationship of the separate parts to each other.
Figure 6:
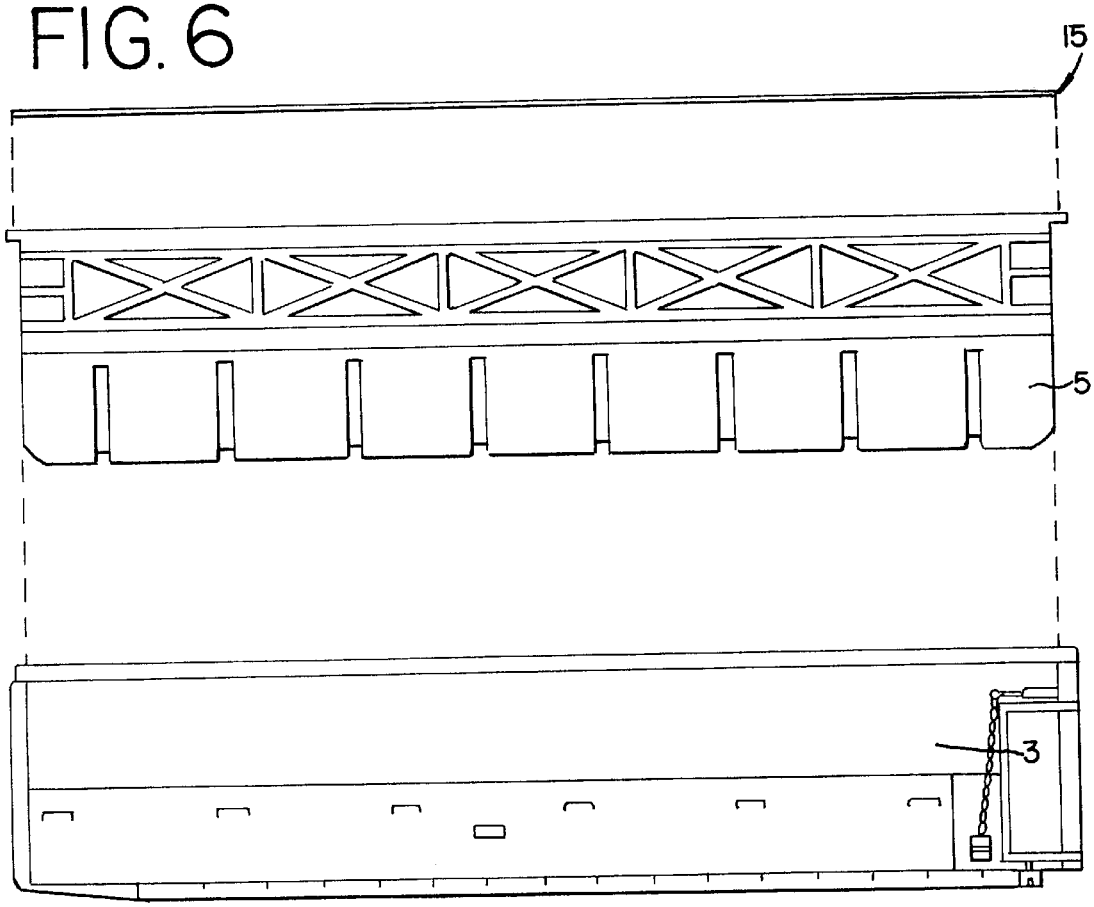
FIG. 6 is a side view of the liner, container and sealing member of FIG. 5.
Figure 7:
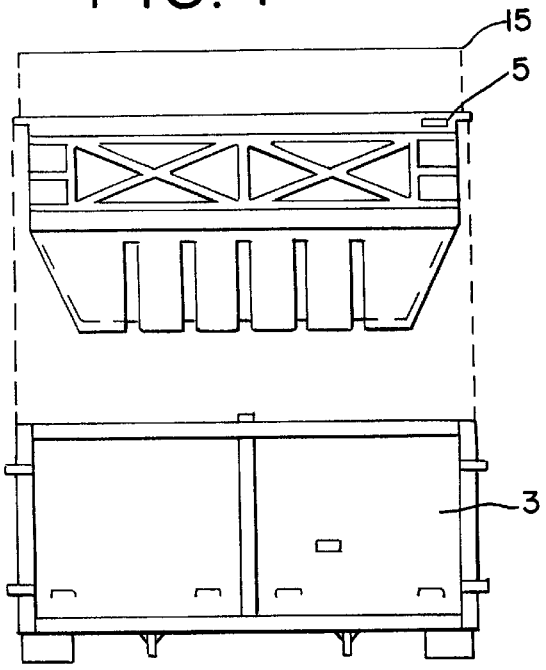
FIG. 7 is an end view of the liner, container and sealing member of FIG. 5.

Referring to FIGS. 1–7, a preferred embodiment of the present invention is described. FIGS. 5–7 shows a waste encapsulation system 1 that is suitable for carrying out the inventive method. As shown in FIGS. 1–7, this system 1 contains a transportable, rigid container 3. In most instances, this container will be a conventional container for waste material and debris, such as a rolloff box, dumpster, waste cart, railcar and/or dump truck. However, any container that is suitable for or adapted for holding waste material in its interior and is sufficiently rigid such that the waste material within the container can be transported to a suitable disposal site may be used in conjunction with the present invention. In a most preferred embodiment, the transportable, rigid container is a rolloff box of the type normally used in conjunction with construction sites.

The transportable, rigid container 3 is most preferably constructed from a structurally sound material such as structural steel. Structural steel provides the best balance of ease of manufacture, structural integrity and durability for continued use. However, other rigid materials, such as rigid plastics, wood, etc. could be used where appropriate.

A liner 5 is provided as an integral part of the preferred embodiment. The liner is adapted to fit within or be disposed within the interior space of the transportable, rigid container. In other words, the liner 5 serves to "line" the interior of the transportable, rigid container 3.

In a most preferred embodiment, the liner substantially conforms to the interior configuration of the transportable, rigid container. In this most preferred embodiment, the available space for containing the waste material to be disposed of is maximized. Also, substantial confirmation of the liner to the interior of the transportable, rigid container tends to reduce or eliminate the movement of the liner against the interior surfaces of the container during transportation. This in turn would tend to minimize any damage that might be inflicted to the integrity of the liner caused by undue movement of the liner during transportation. However, in the case where the liner does not substantially conform to the interior surface of the container, it would be possible to minimize any potential for transportation related damage by filling any space between the liner and the interior surface of the container with a suitable filler or bracing material.

Although in the preferred embodiment, a single liner would be placed within a given transportable, rigid container, this need not be the case. Instead, multiple liners could be placed within a single container. Then, in accordance with the invention, at least one of those liners would be treated by the inventive method, though preferably all of the liners would be so treated.

The liner 5, in a most preferred embodiment, is formed with a bottom 7, two sidewalls 9 and two endwalls 11. In this most preferred embodiment, the liner forms a substantially rectangular box with an open top. The top edges of the sidewalls 9 and endwalls 11 thereby define the opening 13. This opening is adapted to receive the waste material to be disposed of.

As can be seen in the drawings, in a most preferred embodiment of the present invention, the sidewalls 9 have a substantially perpendicular upper portion and an angled lower portion. This results in the bottom 7 having a smaller profile than the opening 13. This configuration of the sidewalls eases the insertion of the liner into the transportable, rigid container and eases the removal of the liner from the rigid transportable container at the disposal site. However, many other shapes of the liner would be appropriate according to the present invention.

The bottom, sidewalls and endwalls of the preferred liner may be manufactured to include structural strengthening ribs 17. These ribs help the structural integrity and the rigidity of the liner, though liners without structural ribs could be constructed according to the present invention.

An important and advantageous feature of the liner according to the preferred embodiment is that it has sufficient rigidity such that the liner is self-supporting when filled with the waste material and/or fill material in the absence of the transportable, rigid container. This feature is important since the liner with the waste material sealed inside will be expected to maintain its structural integrity during the disposal process and after final disposal. Thus, the construction of the liner should desirably result in a liner that is freestanding with the waste/fill material in its interior in the absence of the transportable, rigid container, and is most desirably freestanding even when empty.

Another important and advantageous feature of the liner according to the preferred embodiment is that the liner be constructed in a way such that it is substantially impermeable to liquids. Thus, any liquids that may be present in the waste materials inserted into the liner will tend to remain within the liner. Additionally, any liquids that may be present in the environment into which the sealed liner is placed for ultimate disposal will tend to be isolated from the waste materials encapsulated within the sealed liner.

Yet another important and advantageous feature for the liner of the preferred embodiment is that it be substantially resistant to chemical degradation. This resistance to degradation include two elements. First, the liner should be resistant to chemical degradation by the waste material to be encapsulated within the sealed liner. Second, the liner should be substantially resistant to degradation by any materials which the sealed liner may come in contact with in its eventual disposal site. Such materials might include leachate from the landfill, other waste materials that are disposed of next to or in contact with the sealed liner and any microbes or other chemically active agents that might be present at the disposal site.

The liner should desirably be constructed such that it may be sealed once the waste material is placed within its interior. This seal should preferably be of the type that is substantially impermeable to liquids for the same reasons discussed above with respect to the construction of the liner itself In a most preferred embodiment, a sealing member 15 is provided that substantially conforms to the shape of the opening. In most instances, the sealing member would be constructed of the same material as the liner and would include the same advantageous features, i.e., be substantially impermeable to liquids and be substantially resistant to chemical degradation. In the preferred embodiment shown in the drawings, the sealing member 15 would comprise a substantially rectangular sheet that fits over and covers the opening. In this embodiment, the opening and the sealing member are adapted to be impermeably sealed to each other, thereby encapsulating the waste material in the interior of the liner in a sealed liner.

Any waste material that can be successfully encapsulated and/or isolated within a given liner may be placed within that liner. In a most preferred embodiment, the present invention is used with hazardous debris as defined above. In this particular embodiment, the present invention provides a safe, easy to use and cost effective means of disposing of hazardous debris. However, the present invention may be used with virtually all other types of waste materials and provide some or all of these same advantages, including, for example, nonhazardous debris, solids, semisolids, sludges, including hazardous and nonhazardous sludges from wastewater treatment or other pollution control devices, filter cakes, mineral processing and refining waste by products, polychlorinated biphenyl containing wastes, asbestos contaminated wastes and lead paint abatement wastes.

The liner 5 may be constructed from any material that is compatible with the waste material to be encapsulated or that is resistant to chemical degradation from the contained waste, landfill or other leachate, microbes and/or landfill waste, that substantially reduces the transmission of liquids through the material, and that has sufficient rigidity in order to be self-supporting. Examples of acceptable materials that can be used to construct the liner include polyethylene, especially high density polyethylene polymer, polyvinyl chloride and other plastics.

In addition, composite materials may be used that include an interior layer and an exterior layer, one or both of which are substantially liquid impermeable. Suitable materials for the interior and/or exterior layer include wood, plywood, cardboard, metal, concrete, plastics, mesh and other materials. Alternatively, composite materials can be used to form the liner where only one surface, i.e., the interior or the exterior of the liner has the desirable features of rigidity, etc. For example, the liner could be formed of a rigid shell or frame, which provides the necessary rigidity. The rigid shell is then itself lined with a film or sheet of a substantially liquid impermeable plastic. This film could be adhered to the rigid shell or simply loosely fit into the interior of the rigid shell.

In a most preferred embodiment, the liner is formed from a plastic material as a unitary structure. In this embodiment, the sidewalls, endwalls and bottom are formed as one unit without seams. In a most preferred embodiment, the liner is made from high density polyethylene.

The thickness of the liner will depend in large part upon the material being used to construct the liner. The material should be thick enough to provide the desired toughness, strength and rigidity, as well as the desired level of liquid impermeability and resistance to chemical degradation. In general, the walls and bottom of the liner should not be too thick in order to minimize the cost of construction and the ease of construction. Also, walls that are too thick would render the liner unnecessarily heavy and make the handling of the liner more difficult.

In the preferred embodiment using a plastic material, the typical thickness of the resulting liner is at least about 100 mils, more preferably from about 150 mils to about 300 mils. However, liner thicknesses of from about 400 mils to about 550 mils or greater may be used.

It should be understood that the thickness of the liner will in most cases not be uniform. The liner is most desirably formed, even as a unitary structure, with sufficient thicknesses where needed in order to provide structural integrity and sufficient rigidity. Typically these locations of sufficient thickness occur at the edges between the walls and the bottom. Also, as described above, the preferred liner includes structural ribs 17 that provide a stronger, more rigid liner with a given amount of plastic. Thus, the reference to average thicknesses refer to the typical thickness of the liner at a portion that is not intentionally thickened to impart structural integrity. However, it also should be understood thinner thicknesses may be used depending upon the particular material selected for construction of the liner, the size of the liner and its intended use.

In a most preferred embodiment, the liner is formed as a unitary structure from a high quality, high molecular weight, high density polyethylene resin, such as Paxson 4261A Q-450 HDPE resin. This particular resin is chemically resistant, free of leachable additives and resistant to ultraviolet degradation. This particular resin has the following typical properties.

| PROPERTY | ASTM | UNIT | VALUE |
|---|---|---|---|
| Density | | | |
| (Natural) | D 1505 | g/cm$^3$ | 0.946 |
| (Black) | | | 0.957 |
| Vicat Softening Point | D 1525 | ° C. | 122 |
| Melt Index (Condition F) | D 1238 | g/10 min | 6 |
| Tensile Yield Strength | D 638 | psi | 3400 |
| Flexural Modulus | D 790 | psi | 150,000 |
| Impact Strength (Tensile) | D 1822 | ft-lbs/sq. inch | 340 |
| Brittleness Temperature | D 746 | ° C. | <−76 |
| Shore Hardness D | D 2240 | points | 67 |

The sealing member is desirably formed of the same material as the liner. In other words, the most preferred embodiment of the liner includes a sealing member made from a high density polyethylene resin, this resin being likewise substantially impermeable to liquids, having an average thickness of at least about 100 mils and being resistant to chemical degradation.

The liner may be constructed by any conventional means. For plastic liners, this would include all types of welding or joining, vacuum forming, sealing, blow molding, etc. In such cases, the initial plastic sheet material used to form the liner would preferably have thicknesses of from about 100 to about 500 mils. A particularly preferred way of manufacturing a preferred liner of unitary plastic structure is by a thermal forming technique such as vacuum forming or blow molding. For liners made from a composite of materials, the liquid impermeable layer may be incorporated by any conventional means, such as spraying, dipping, coating, bonding, welding or other means.

According to the preferred embodiment of the inventive method, a transportable, rigid container, such as a rolloff box is provided and a liner of the type described above is disposed or placed within the interior of the container. In this configuration, the liner defines an interior space and has an opening, preferably at the top, that is adapted to receive the waste material of interest.

The waste material of interest, most preferably hazardous debris, is then placed into the interior of the liner through or via the opening. In this manner, the liner is filled with waste material. Void filling material may be added before, along with or after the waste material. T he filling material acts to stabilize any movement of the waste material during transportation and disposal and also provides enhanced structural rigidity for the filled and/or sealed liner. Any inert material may be suitably used as a void filing material, such as inert solids, soils, sands and other fine-grained material having a substantial compressive strength that resists compression due to the forces normally encountered in the handling of the liner.

At the appropriate time, no more waste or fill material is placed into the liner and the liner is sealed by forming a substantially liquid impermeable seal over the opening of the liner. In this manner, the waste material in the interior of the liner is encapsulated within the liner. This forms a sealed liner encapsulating the waste material.

The substantially liquid impermeable seal can be formed by any conventional means. Most preferably, the liquid impermeable seal is formed by heat welding the sealing member to the liner, though chemical and ultrasonic welding or an adhesive material may be used as well. In a preferred embodiment of the inventive method, the liner is sealed by positioning an appropriately shaped sealing member in the opening of the liner and forming a substantially liquid impermeable seal between the sealing member and the opening.

In the absence of the use of a sealing member, the opening of the liner could be sealed in any manner in which the waste material within the liner is safely encapsulated in the sealed liner.

Having appropriately sealed the opening of the liner, the waste material within the sealed liner may now be safely disposed of.

In another preferred embodiment of the present invention, the rigid, transportable container, the liner and the waste material inside of the liner are transported by conventional means to an appropriate disposal site. The type of transportation used would often depend upon the particular type of transportable, rigid container used. For example, in the case of rolloff boxes, either vehicles such as trucks or rail platforms could be used. In the case of dumpsters, the truck associated with the dumpster would most advantageously be used to achieve transportation to the disposal site.

The transportation step is independent of the sealing step in time. In other words, the sealing step may take place before transportation to the disposal site, during transportation or after the liner and container have arrived at the disposal site. Indeed, the sealing step could occur after the liner containing the waste material had been removed from the transportable, rigid container at the disposal site. In a most preferred embodiment, the sealing step occurs at the disposal site, but while the liner is still contained within the transportable, rigid container.

After the liner has been sealed encapsulating the waste material within the liner, the sealed liner may then be appropriately placed at the disposal site for final disposal. This might desirably include the use of a crane in order to lift the sealed liner containing the waste material and to appropriately place it at the sanitary landfill.

Only certain preferred embodiments of the present invention have been specifically described. Other embodiments that have not been described may nonetheless fall within the spirit and scope of the following claims. Such embodiments would preform substantially the same function in substantially the same way to achieve substantially the same result as the inventive method and system.

We hereby claim as our invention:

1. A method for encapsulating waste material for safe disposal thereof comprising the following steps in combination:

a. providing a transportable, rigid container having a liner disposed within the container, the liner defining an interior and an opening adapted to receive waste material;

b. placing waste material in the interior of the liner via the opening;

c. sealing the waste material in the interior of the liner by forming a substantially liquid impermeable seal over the opening thereby encapsulating the waste material within the sealed liner; and removing the liner containing the waste material from the transportable, rigid container prior to disposal of the liner containing the waste material;

the liner containing the waste material being of sufficient rigidity such that the liner is self supporting in the absence of the transportable, rigid container, and the liner being substantially impermeable to liquids and substantially resistant to chemical degradation, such that the waste material encapsulated within the sealed liner may be safely disposed of.

2. The method of claim 1 comprising the additional step of:

d. transporting the container, the liner, and the waste material inside of the liner to a disposal site, step d occurring before, during or after step c.

3. The method claim 2 comprising the additional step of:

e. disposing of the sealed liner encapsulating the waste material at the disposal site.

4. The method of claim 1 comprising the additional step of:

f. placing fill material in the interior of the liner via the opening to fill at least some of the void space formed between the waste material and the liner.

5. The method of claim 1 in which the shape of the liner substantially conforms to the internal shape of the transportable, rigid container.

6. The method of claim 1 in which the transportable, rigid container is a rolloff box, rail car, dump truck or a dumpster.

7. The method of claim 1 in which the liner comprises high density polyethylene having an average thickness of at least about 100 mils.

8. The method of claim 1 in which the seal is formed by heat welding or by means of an adhesive.

9. The method of claim 1 in which the liner comprises four substantially vertical walls and a substantially horizontal bottom, the top edges of the four walls defining the opening.

10. The method of claim 9 in which at least one of the walls and/or the bottom of the liner comprises a plurality of structural strengthening ribs.

11. The method of claim 1 in which the liner is formed as a unitary structure.

12. The method of claim 11 in which the liner is formed by means of thermal forming.

13. The method of claim 1 in which the liner is formed as a composite structure.

14. The method of claim 1 in which the waste material comprises hazardous debris.

15. The method of claim 1 in which the sealing comprises positioning a sealing member in the opening and forming a substantially liquid impermeable seal between the sealing member and the opening.

16. A waste encapsulation system for safe disposal thereof comprising a transportable, rigid container and a liner disposed within the container, the liner defining an interior and an opening adapted to receive waste material;

the liner containing the waste material having sufficient rigidity to be self supporting in the absence of the transportable, rigid container, the liner being substantially impermeable to liquids and substantially resistant to chemical degradation, the liner being adapted to form a substantially liquid impermeable seal over the opening, such that the system may receive waste material in the interior of the liner via the opening and the waste material may be encapsulated within the sealed liner, transported in the transportable, rigid container to a disposal site, removed from the transportable rigid container and disposed of at the disposal site.

* * * * *